US005711747A

United States Patent [19]

Steinback

[11] Patent Number: 5,711,747

[45] Date of Patent: Jan. 27, 1998

[54] ELASTIC EXERCISE BANDS AND CUFFS

[76] Inventor: Jyl L. Steinback, 15202 N. 50th Pl., Scottsdale, Ariz. 85254

[21] Appl. No.: 346,565

[22] Filed: Nov. 29, 1994

[51] Int. Cl.[6] ..... A63B 21/02

[52] U.S. Cl. ..... 482/124; 482/44; 482/122

[58] Field of Search ..... 482/44, 121, 122, 482/124, 125, 91; 2/16, 160, 162, 161.1, 161.2; 273/185 R, 188 A, 189 R

[56] References Cited

U.S. PATENT DOCUMENTS

| | | | |
|---|---|---|---|
| 1,699,219 | 1/1929 | Bemish et al. | 273/189 R |
| 4,019,734 | 4/1977 | Lee et al. . | |
| 4,026,549 | 5/1977 | Gunn . | |
| 4,090,706 | 5/1978 | Reda | 482/122 |
| 4,245,840 | 1/1981 | Van Housen . | |
| 4,540,173 | 9/1985 | Hopkins, Jr. . | |
| 4,815,731 | 3/1989 | Suarez et al. . | |
| 4,909,505 | 3/1990 | Tee | 482/122 |
| 4,955,608 | 9/1990 | Dougherty et al. . | |
| 5,020,796 | 6/1991 | Ullmann . | |
| 5,129,647 | 7/1992 | Castellanos . | |
| 5,203,754 | 4/1993 | Maclean . | |
| 5,230,682 | 7/1993 | Myers | 482/122 |
| 5,263,916 | 11/1993 | Bobich | 482/124 |
| 5,308,305 | 5/1994 | Romney | 482/124 |
| 5,336,151 | 8/1994 | Van Ballegooie . | |
| 5,344,373 | 9/1994 | Greene | 482/124 |
| 5,433,688 | 7/1995 | Davies | 482/124 |

*Primary Examiner*—Richard J. Apley
*Assistant Examiner*—Jeanne M. Clark
*Attorney, Agent, or Firm*—Snell & Wilmer L.L.P.

[57] ABSTRACT

An exercise device for exerting a resilient force upon the limbs of the user having two cuffs and a continuously formed looped tension band. The cuffs are generally made of a webbing fabric having secured at opposite ends VELCRO strips for securement about the limbs of the user. The cuffs are generally made of a webbing fabric having secured at opposite ends strips made of synthetic materials which adhere when pressed together such as that material sold under the trademark VELCRO for securement about the limbs of the user. Provided on the exterior of the cuff is an envelope-like enclosure having a closure which is formed from the same adhereable synthetic materials such as those sold under the trademark VELCRO, whereby the tension band is placed within the flaps of the envelope-like enclosure and the flaps are secured about the tension band. In use, the cuffs are secured about the limbs of the user using the VELCRO strips. Once secured, the envelope-like enclosure is then positioned on the exterior aspect of the limb. The chosen continuously formed tension band is positioned and secured within the envelope-like enclosure of each cuff. The user when moving the limbs in opposite directions receives a resilient force, thereby exercising the limbs associated with the exercise device.

11 Claims, 1 Drawing Sheet

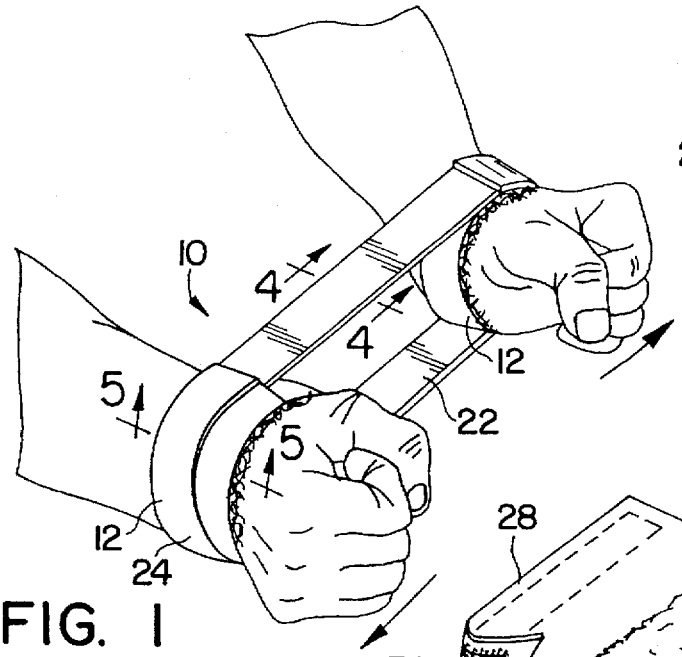
FIG. 1
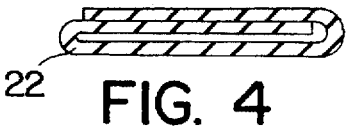
FIG. 4
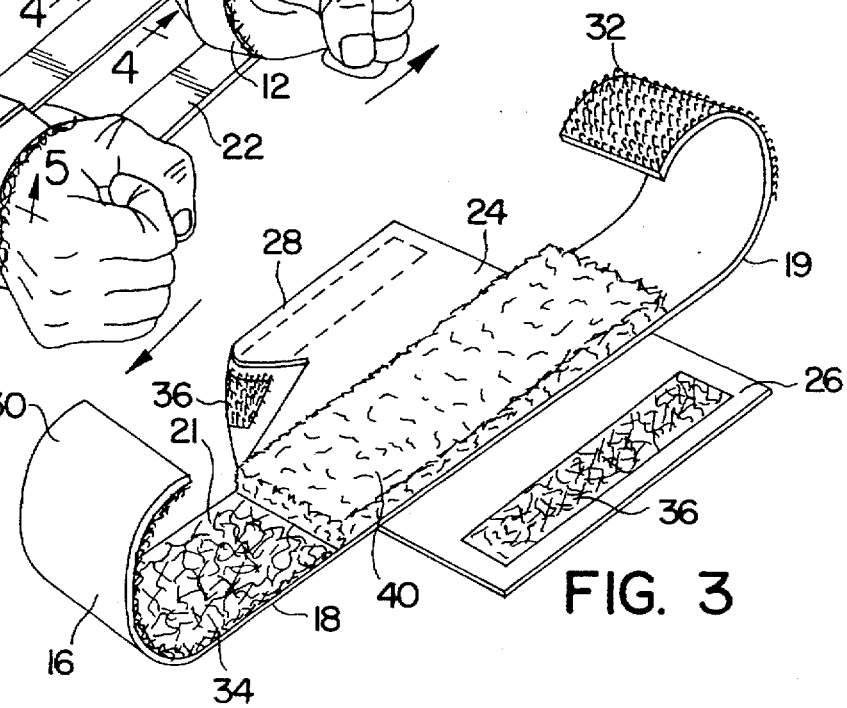
FIG. 3
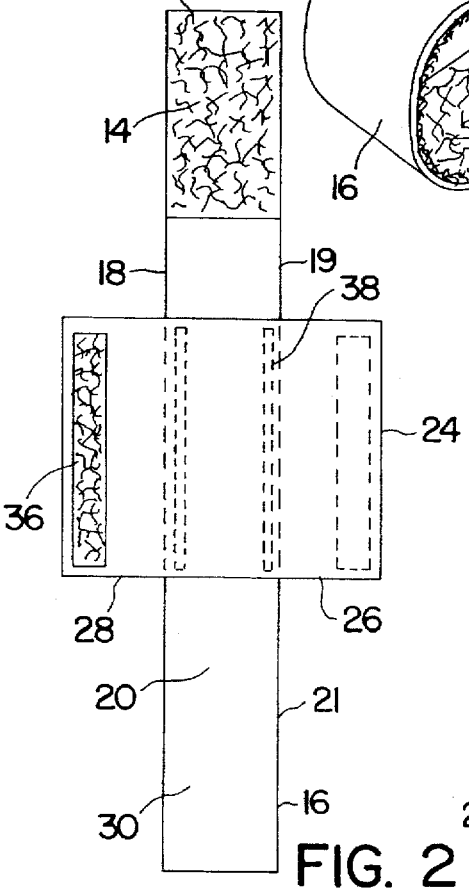
FIG. 2
FIG. 5
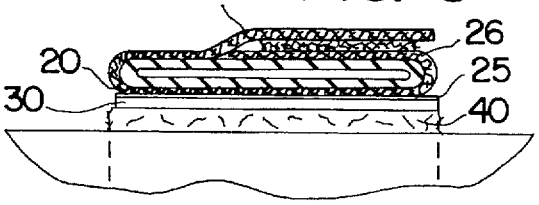
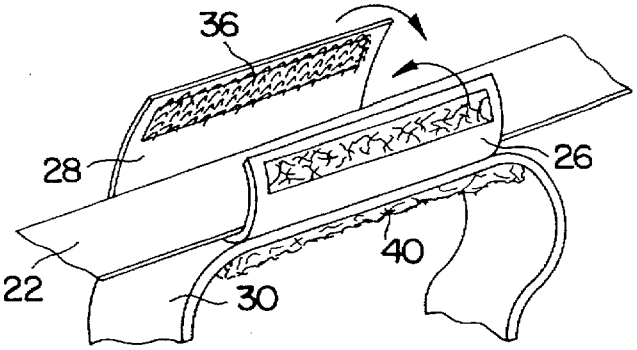
FIG. 6

ELASTIC EXERCISE BANDS AND CUFFS

TECHNICAL FIELD

The present invention relates to an exercise device for use in resistive type exercise movements using the muscles of the user's limbs. More particular, the device is for use in conjunction with exercises which are performed so as to create resistance against the movement of the limb sought to be exercised. The device is for aid in assisting the user to exercise and firm up the muscles of the upper and lower body through the use of varying amounts of tension. It is primarily for use in a standing, sitting or lying positions commonly associated with floor work. The apparatus comprises cuffs having integrally formed an envelope-like enclosure in which a plurality of continuously formed tension bands are interchangeably placed. The degree of tension chosen is determined by the users skill and choice of exercise.

BACKGROUND OF THE INVENTION

There exist today, numerous exercise devices for use by the average consumer which operate by allowing resistive forces to work muscle. In particular, there are currently on the market many devices which incorporate the use of bands and cuffs for application of this resistive movement. In use, these known devices allow the user to undergo a resistive type movement, thereby affecting the muscle in a positive way and assisting the user in the build up of the muscle and cardiovascular system. However, the prior art has failed to address the need for a resilient exercise device that incorporates a cuff, capable of allowing the user to interchange a variety of continuously formed tension bands without the fear of the bands becoming separated due to a failure in the method of tying off the bands through an aperture or channel provided in the cuff.

The Suarez, et al. patent, U.S. Pat. No. 4,815,731 issued on Mar. 28, 1989 discloses an exercise device which is suitable for attachment to the limbs of the individual user. As disclosed by this patent, the device is comprised of a coil tension spring which extends between the cuffs of the device. There is provided a reinforcing strip of material, mounted on the cuff, which forms a loop for securing the resistance spring and elastic cord to the cuff.

Described in the Bobich patent, U.S. Pat. No. 5,263,916, issued on Nov. 23, 1993, is a similar resilient type exercise device comprised of a wrist cuffs, foot cuffs and elastic cords. As disclosed, the device is comprised of: a one-piece wrist cuff, having VELCRO closure and a means for attachment of the first end of the elastic cord to said wrist cuff; a one-piece foot cuff, suitable for wearing underneath the user's athletic shoe, having VELCRO closure and a means for attachment of the second end of the elastic cord to the foot cuff; and a flattened elastic cord having a first and second end and coupling means attached to each end. The preferred means for attaching the elastic cords to the cuffs are a plurality of clip and ring devices.

The Van Housen patent, U.S. Pat. No. 4,245,840, issued on Jan. 20, 1981, discloses a resistive exercise device comprised of a dual piece elastic cord member having attached at its first two ends, handhold means, and at its second two ends, foothold means. In addition, provided in the middle is an adjustable friction type connector which is slidably attached so as to allow for the adjustment in length and tensity of the cord.

While these devices are similar in basic concept, they do not allow for variable tensioning, through the use of continuously formed tension bands which are placed in an envelope-like enclosure on the exterior of the cuff. The tension band provided can be interchanged according to the degree of tension sought, thereby increasing difficulty of the exercise which is determined by the skill and the physical ability of the user. In addition, the majority of the exercise devices of this type currently on the market utilize tension cords of a determinate length and having two ends in which attachment to the cuff consists of passing the ends through apertures or channels provided in the cuffs. Thereafter the ends of the cord are tied to each other, or in the alternative tied to form a knot of sufficient size to prevent the cord from slipping back through the aperture or channel formed in the cuff. In a device configured as such, there exist the possibility that the cord will become detached from the cuff, due to failure of the knotted cord during use, thereby causing interruption to the user and possible injury.

The primary reason for exercise is physical improvement. However, if the exercise is too strenuous injury or lack of interest occurs instead of the desired benefit. Provided is a simple, easy to use resistive device which allows for the user to interchange continuously formed tension bands and cuffs according to the degree of skill and athletic ability the user possesses.

The present invention consists of three basic parts: two cuffs, worn around the limbs the user is exercising and a tension band, chosen from a plurality of continuously formed tension bands, capable of being interchanged and held in place by the associated cuffs. The cuffs of the present device are comprised of a webbing strip whereby the length of said webbing strip is larger than the periphery of the limb sought to be encompassed. The webbing strip has provided lamb's skin with wool attached on its interior aspect, thereby lending protection to the skin of the user. In addition, provided is a complimentary hook and loop type fastener strip, positioned on opposite sides of the ends of the webbing strip. There is centrally positioned on the exterior of the webbing strip, an envelope-like enclosure, preferably comprised of a semi-rigid plastic, having provided a complimentary hook and loop type fastener strip of sufficient strength to provide a means for closure of the envelope-like enclosure, thereby securing the tensioning bands within the enclosure. This envelope-like enclosure allows for the interchanging of a plurality of tension bands by the user. Provided as tension means are a plurality of bands, generally looped in configuration. Each band of the preferred embodiment is comprised of flat elastic material which has been folded and sealed to produce a band approximately two inches in width and continuous in form. Alternate bands of differing configurations, yet continuous in formation are contemplated. The bands of the preferred embodiment are provided in various tensions through the use of varying elastic materials. The continuous formation of the tension bands in conjunction with the envelope-like enclosure of the cuffs, permits the bands to be interchanged without the apprehension by the user that the elastic will become disengaged from the cuff through failure of the securement of an end generally associated with determinate length tension bands.

In use, the webbing strips, which comprise the cuffs of the preferred embodiment of the present device, are placed around the users limbs and secured by a complimentary hook and loop type fastener strip. The appropriate tension band is then secured within the envelope-like enclosure formed on the exterior aspect of the webbing strip. Next, the envelope-like enclosure formed on the webbing strip is positioned in a manner so as to allow the force of the tension band to pull opposite the complimentary hook and loop type fastener of the envelope-like enclosure. This is shown and depicted in the provided drawings.

SUMMARY OF THE INVENTION

The primary reason for exercise is physical improvement. However, if the exercise is too strenuous injury or lack of interest occurs instead of the desired benefit. Accordingly, an object of the present invention is to provide a resistive exercise device appropriate for use by both the amateur and professional athlete.

More specifically, it is the object of the present invention to provide for a resistive exercise device which has provided cuffs and continuously formed tension bands, formed so as to prevent unexpected disengagement of the bands from engagement with the cuffs.

Another object of the present invention is to provide a cuff having a means of attachment formed therein, for use in resistive exercises which provides for the interchanging of continuously formed tension bands dependent on the skill of the user and the exercise sought to be achieved.

Disclosed is an exercise device comprised of a plurality of cuff members and tension bands. The cuff members of the present invention have provided an envelope-like enclosure which provides for a means of attachment of the continuously formed tension band to the exterior of the cuff when positioned about the user limb. In providing the tension bands of the present device, an elastic material is folded and seam sealed so as to provide a tension band of continuous formation having no ends. The bands of the present device are interchangeable dependent on the degree of tension sought and easily positioned within the envelope-like enclosure provided on the cuff.

Other objects, advantages, and novel features of the present invention will become apparent from the detailed description that follows, when considered in conjunction with the associated drawings.

BRIEF DESCRIPTION OF THE DRAWINGS

FIG. 1 is a perspective view showing the cuff and band system of the present invention positioned about the wrists of the user.

FIG. 2 is a plan view of the cuff of the present system showing the attached envelope-like enclosure.

FIG. 3 is a perspective view of the cuff of the present system shown in open form.

FIG. 4 is a section view of the band taken along line 4—4 of FIG. 1.

FIG. 5 is a section view of the cuff and band of the present system taken along line 5—5 of FIG. 1 showing the configuration of the cuff and band when in use.

FIG. 6 is a perspective view of the band and cuff of the present system showing placement of the band in the envelope-like enclosure of the cuff and method for engaging the tension band within the envelope-like enclosure.

DETAILED DESCRIPTION OF THE PREFERRED EMBODIMENT

Referring particularly to the drawings, there is shown the elements of the device of the present invention. In FIG. 1 there is shown the cuff and band system 10 of the present invention when attached to the user's wrist. The device is comprised of a plurality of cuffs 12 having formed on the exterior surface, an envelope-like enclosure 24 for placement and securement of tension band 22. As shown in FIG. 1, the cuffs 12 of the present device are secured on the limbs of the user sought to be exercised through the use of strips of complimentary hook and loop fasteners, such as that sold under the trademark VELCRO. FIG. 1 shows securement of the cuffs 12 on the wrists of the-user for exercise of the arms and shoulders. In use the tension band 22 is placed within the envelope-like enclosure 24 of the cuff 12.

Referring now to FIGS. 2 and 3, shown is the preferred embodiment of the cuff 12 of the present invention in plan view and perspective. The cuff 12 is comprised of a flattened strap having a first end 14, a second end 16, two side edges 18 and 19, an outer flat surface 20 and inner flat surface 21. The cuff 12 is generally comprised of fabric webbing 30. Secured to the webbing 30 at opposite flat surfaces of the first end 14 and second end 16, by stitching, gluing or some other means for securement, are strips of complimentary hook and loop type fasteners 32 and 34. Other securement means such as buttons, hooks, zippers, clips or laces are also contemplated here. Located on the inner flat surface 21 of the cuff 12 there is embodied lamb's skin with wool attached 40 for protection of the user against friction caused by the cuff 12 against the user's skin surface when in use. The lamb's skin with wool attached 40 is secured to the webbing 30 by an appropriate means for securement such as stitching 38 or gluing. The lamb's skin with wool attached 40 is secured to the inner flat surface 21 of cuff 12 and rests against the users limb when in use. Shown in FIG. 2 is the stitching 38 for attachment of the lamb's skin with wool attached 40 and envelope-like enclosure 24.

The envelope-like enclosure 24 of the present invention is secured to the outer surface 20 of cuff 12 or alternatively, integrally formed with cuff 12. There is contemplated to locate between the outer surface 20 of cuff 12 and the adjacent surface of the envelope-like enclosure 24, a stiffener, to aid in the distribution of pressure created by the cuff and band system during exercise. The envelope-like enclosure 24 is comprised of a first flap member 26 and a second flap member 28 as shown in FIGS. 2 and 3. Secured to the outermost edge of the first flap member 26 and second flap member 28 are strips of complimentary hook and loop fasteners 36. In use the selected continuously formed tension band 22 is placed within flap members 26 and 28 of the envelope-like enclosure 24. The first flap member 26 is folded over the tension band 22 sought to be used and the second flap member 28 is folded over the edge of the first flap member 26 both having secured thereto strip fasteners 36. The strips of complementary hook and loop fasteners 36 of the first flap member 26 and the second flap member 28 are secured and the device is ready for use.

As shown in FIGS. 3 and 6, webbing 30 of the cuff 12 of the present device is positioned for securement about the user's limb with the lamb's skin with wool attached 40 positioned interior the cuff 12. The strips of complimentary hook and loop fasteners 32 and 34 affixed to the webbing 30 are secured thus allowing proper positioning about the user's limb to be achieved.

Shown in FIG. 4 is a cross section of the tension band 22 of the present device taken along line 4—4 of FIG. 1. As disclosed, the preferred band 22 is folded so as to achieve sufficient tension strength and seamed sealed at its edges. The band is looped in configuration and formed continuously with no ends. Generally, the band 22 may be formed of an indeterminate number of varying thicknesses and materials, thus allowing for varying tension strengths to be achieved in various bands of which the user can choose from.

Referring now to FIG. 5, shown is a section view of the cuff 12 and tension band 22 of the present system taken along line 5—5 of FIG. 1. Shown is the configuration of the cuff 12 and band 22 when in use having lamb's skin with wool 40 placed in contact with the skin surface of the user. The first flap 26 and second flap 28 of the envelope-like enclosure 24 are shown when secured about the tension band 22. The envelope-like enclosure 24 is secured to the outer surface 20 of the webbing 30 of cuff 12, having located between the outer surface 20 of the webbing 30 and the envelope-like enclosure 24, stiffener 25, to promote pressure distribution during use. This location of the envelope-like enclosure 24 on the outer surface 20 of webbing 30 permits interchanging of tension band 22.

As shown in FIG. 6, when in use, the tension band 22 is placed upon the outer surface 20 of webbing 30 which comprises cuff 12. The first flap 26 of the envelope-like enclosure 24 is then folded down over the tension band 22. The second flap 28 of the envelope-like enclosure 24 is then folded down over the first flap 26, thereby allowing the strips of complementary hook and loop fasteners 36 to come in contact and secure flaps 26 and 28 in a closed position. The user is now able to perform various exercises by expanding the width between the two cuffs 12, thereby tensioning the band and causing resistance to the muscle being exercised. When the user desires to change the tension band 22 to a tension band of lesser or greater tension, the first flap 26 and the second flap 28 are forced apart, thereby breaking the contact between the strips fasteners 36. The tension band 22 is then free to be exchanged with an alternate tension band 22 of different tension and subsequently secured in position.

It will be apparent to those skilled in the art, that the foregoing detailed description of the preferred embodiment of the present invention is representative of a type of exercise band and cuff device within the scope and spirit of the present invention. Further, those skilled in the art will recognize that various changes and modifications may be made without departing from the true spirit and scope of the present invention. Those skilled in the art will recognize that the invention is not limited to the specifics as shown here, but is claimed in any form or modification falling within the scope of the appended claims. For that reason, the scope of the present invention is set forth in the following claims.

What is claimed is:

1. An exercise device comprised of:

a plurality of cuff members comprised of a substantially flat strap whereby said flat strap is longer than the periphery of a user's limb sought to be encompassed, each of said straps adapted to be formed into loops for receiving the limb of the user and having a first end, a second end, an inner flat surface, an outer flat surface and a means for securement about the limb of the user;

an envelope-like enclosure formed on the outer flat surface of each of said cuff members comprising a first flap member and a second flap member each extending from opposite sides of said flat strap and along opposite lengths of said flat strap such that they overlap at a center of the outer flat surface of said cuff members along a substantial length of said flat strap in that said envelope-like enclosure is adapted to surround at least the outer surface of the user's limb when folded over the outer surface of said flat strap, and a means for securing the first flap member to the second flap member; and at least one elongate resilient element continuously formed into a loop configuration for securement within said envelope-like enclosures formed on said outer flat surface of each of said cuff members.

2. The exercise device of claim 1, wherein said substantially flat strap is comprised of fabric webbing.

3. The exercise device of claim 1, wherein said means for securement comprises at least one strip of complementary hook and loop fastener on the inner surface of said first end and at least one reciprocating strip of complimentary hook and loop fastener on said outer surface of said second end.

4. The exercise device of claim 1, wherein said means for securement comprises at least one strip of complementary hook and loop fastener on the outer surface of said first end and at least one reciprocating strip of complimentary hook and loop fastener on said inner surface of said second end.

5. The exercise device of claim 1, further comprised of a piece of lamb's skin with wool attached, positioned and secured equi-distant between said first end and said second end of said inner surface of the cuff.

6. The exercise device of claim 1, further comprised of a stiffener element positioned between said outer flat surface of said flat strap and said envelope-like enclosure.

7. An exercise device comprised of:

a plurality of cuff members comprised of a substantially flat strap whereby said flat strap is longer than the periphery of a user's limb sought to be encompassed, each of said straps adapted to be formed into loops for receiving the limb of the user and having a first end, a second end, an inner flat surface, an outer flat surface, and at least one strip of complimentary hook and loop fastener secured to said first end and said second end on opposite flat surfaces;

a piece of lamb's skin with wool attached, positioned and secured equi-distant between said first end and said second end on said inner flat surface;

an envelope-like enclosure formed on said outer flat surface of each of said cuff members, comprising a first flap member having secured thereto a strip of complimentary hook and loop fastener and a second flap member having secured thereto a reciprocating strip of complimentary hook and loop fastener wherein the first and second flap members extend outwardly from opposite sides of said flat strap and along opposite lengths of said flat strap such that they overlap at a center of the outer flat surface of said cuff members along a substantial length of said flat strap adapted to surround at least the outer surface of the user's limb when folded over the outer surface of said flat strap;

a stiffener element positioned between said outer surface of said flat strap and said envelope-like enclosure; and at least one elongate resilient element continuously formed into a loop configuration for placement within said envelope-like enclosures formed on said outer flat surface of each of said cuff members.

8. The exercise device of claim 7, wherein said substantially flat strap is comprised of fabric webbing.

9. A method for using an exercise device comprising the steps of:

placing at least two cuff members comprised of substantially flat straps about at least two limbs of a user;

securing said straps to the limbs of the user, so as to secure a means for securement of said flat strap, whereby an envelope-like enclosure, comprised of a plurality of oppositely disposed flap members, secured on an outer surface of said strap is positioned on an exterior aspect of the limb;

placing within said envelope-like enclosure a continuously formed loop tension band;

folding said plurality of flap members of said envelope-like enclosure of each cuff member over said tension band such that said flap members overlap at a midpoint above the outer surface of said strap along a substantial length of said strap in that said envelope-like enclosure is adapted to surround at least the outer surface of the user's limb so as to secure a means of securement about said tension band; and forcing the user's limbs in opposite directions, thereby creating a resistive force on the limbs of the user.

10. The method for using an exercise device of claim 9, wherein said means for securement of said flat strap about the limb of the user comprises the step of attaching complimentary hook and loop fasteners secured to said flat strap.

11. The method for using an exercise device of claim 9, wherein said means for securement of said flap members of said envelope enclosure comprises the step of attaching complimentary hook and loop fasteners.

* * * * *